US010596687B2

(12) United States Patent
Chuang

(10) Patent No.: US 10,596,687 B2
(45) Date of Patent: Mar. 24, 2020

(54) TORQUE SOCKET HAVING LOCKING AND RELEASING FUNCTION

(71) Applicant: Wei-Chieh Chuang, New Taipei (TW)

(72) Inventor: Wei-Chieh Chuang, New Taipei (TW)

( * ) Notice: Subject to any disclaimer, the term of this patent is extended or adjusted under 35 U.S.C. 154(b) by 188 days.

(21) Appl. No.: 15/970,287

(22) Filed: May 3, 2018

(65) Prior Publication Data

US 2018/0318990 A1 Nov. 8, 2018

(30) Foreign Application Priority Data

May 8, 2017 (TW) ..... 106206513 U

(51) Int. Cl.
*B25B 23/147* (2006.01)
*B25B 23/142* (2006.01)
*B25B 23/00* (2006.01)

(52) U.S. Cl.
CPC ..... *B25B 23/147* (2013.01); *B25B 23/0035* (2013.01); *B25B 23/1427* (2013.01)

(58) Field of Classification Search
CPC ..... B25B 23/147; B25B 23/1427; B25B 23/0035
See application file for complete search history.

(56) References Cited

U.S. PATENT DOCUMENTS

| | | | | |
|---|---|---|---|---|
| 8,549,963 | B2 | 10/2013 | Chuang | |
| 10,065,296 | B2 * | 9/2018 | Chuang | B25B 15/04 |
| 2018/0297184 | A1 * | 10/2018 | Bailey | B25B 23/1427 |
| 2018/0369998 | A1 * | 12/2018 | Cutler | B25B 13/465 |

* cited by examiner

*Primary Examiner* — David B. Thomas
(74) *Attorney, Agent, or Firm* — Guice Patents PLLC

(57) ABSTRACT

A torque socket having locking and releasing function, comprises: a shaft rod, having a core shaft radially formed with a shaft hole and an outer circumference thereof radially formed with a first friction surface; a shaft cylinder, having two axial sides thereof respectively formed with a shaft slot and a sleeve tube having a sleeve slot, a second friction surface is radially formed inside the shaft slot; and a locking and releasing mechanism, including: a first elastic member, sleeved on the sleeve tube; a slide sleeve, sleeved with the shaft cylinder, the sleeve tube is radially formed with a positioning hole allowing a positioning ball to be received, and an inner circumference of the slide sleeve is formed with a stopping wall and a ball chamber corresponding to the location of the positioning ball during two elastic sliding strokes; and a fasten ring, fastened with the sleeve tube.

10 Claims, 13 Drawing Sheets

A-A

B-B

TORQUE SOCKET HAVING LOCKING AND RELEASING FUNCTION

BACKGROUND OF THE INVENTION

1. Field of the Invention

The present invention relates to a torque socket having locking and releasing function, especially to a torque socket allowing a drive head to be rapidly assembled or disassembled, wherein one end of the torque socket is sleeved with a manual, a pneumatic or an electric rotation tool and another end thereof is sleeved with the drive head.

2. Description of Related Art

A screwdriver is mainly composed of a handgrip and a drive rod having a drive head, the drive head is generally categorized into a flat type or a cross type for matching with a flat or a cross recess formed at the top end of a screw, thereby enabling the screw to be locked or released. Because the drive head of the screwdriver is formed with a fixed shape and dimension, thus another drive head having a different shape and dimension cannot be utilized for replacement.

In view of the disadvantage of the above-mentioned screwdriver, the skilled people in the art have developed a manual tool allowing the drive head to be replaced, for example a wrench, the wrench is sleeved with a socket, an insertion slot at the bottom end of the socket is able to be sleeved with a drive head having different shapes and dimensions, thereby being suitable to be applied in various types of screws. As such, the socket is only served as a torque transferring tool, and the socket itself is not provided with any quantified torque mechanism.

If the above-mentioned rotation tool, such as the screwdriver and the wrench, is desired to be used in an optical device, for example being used for adjusting a lens of a surveillance device, because the torque valve of the rotation tool is defined according to a force applied by a user, the torque could be overly larger during the adjustment process, and the lens may be broken which causes a tremendous loss. Moreover, when the rotation tool, for example the above-mentioned screwdriver or the wrench, is used for rotating a connection member, for example a screw, and the rotation force exceeds the tolerable range of the screw, the thread of the screw may be damaged; accordingly, the above-mentioned disadvantages shall be improved.

In view of the disadvantages of the above-mentioned rotation tool, Taiwan Utility Model Publication No. M414299 (equivalent to China Patent No. 201998113U, U.S. Pat. No. 8,549,963B2, Japan Patent No. U3174153 and German Patent Application No. 102012005885.3) granted to the applicant of the preset invention has disclosed a torque socket; when the torque socket is in a screwing process and the socket does not exceed a preset torque value yet, the screw can be continuously screwed in, when the screw is rotated and positioned, and the preset torque value has been exceeded, a core shaft forms an idle rotating status in a shaft slot, so that the screw can be prevented from being overly locked and tightened, thereby improving the disadvantages of the above-mentioned rotation tool.

The torque socket is formed with a sleeve slot allowing a drive head to be inserted, and an inner end of the sleeve slot is disposed with a magnet for magnetically attracting the drive head, so that the drive head is prevented from falling out from the sleeve slot, and a magnetic force is provided to the drive head for attracting and connecting to a connection member, for example a screw, made of a magnetic inducing material. Because the magnet is able to generate a magnetic field, so any component capable of generating the magnetic field cannot be applied in some medical equipment, for example a cardiac peacemaker, a biological signal sensor or a monitoring device, a nuclear magnetic resonance imaging capturing device, an electron microscope, or a device having a microprocessor for controlling or digital wirings used for life supporting, so that the medical equipment can be prevented from being interfered by magnetism, Accordingly, how to fasten the drive head without using the magnetically attracting means shall be seriously concerned by the skipped people in the art.

SUMMARY OF THE INVENTION

One primary objective of the present invention is to provide a torque socket having locking and releasing function, which comprises a shaft rod sleeved in a shaft cylinder, a friction torque is formed between the shaft cylinder and the shaft rod, so when the torque socket is used for locking and tightening a connection member, for example a screw, and a preset torque value of the torque socket is exceed, an idle rotating status is formed, thereby preventing the connecting member and an object to be combined from being damaged. Meanwhile, the shaft cylinder is further disposed with a locking and releasing mechanism allowing a drive head to be rapidly assembled and disassembled, the locking and releasing mechanism utilizes an interfering or separating mean for locking or releasing the drive head, thereby overcoming a problem of magnetic field interference.

For achieving said objective, one technical solution provided by the present invention is to provide a torque socket having locking and releasing function, which comprises a shaft rod, radially formed with a flange, wherein two sides of the flange are respectively and axially extended with an insertion tenon allowing a rotation tool to be connected and a core shaft axially formed with a shaft hole, an outer circumference of the core shaft is radially formed with at least one cut groove communicated with the shaft hole, and radially formed with a first friction surface; a shaft cylinder, having two axial sides thereof respectively formed with a shaft slot allowing the core shaft to be received and a sleeve tube formed with a sleeve slot, wherein the sleeve slot is served to allow a drive head to be inserted, a second friction surface being in contact with the first friction surface is radially formed inside the shaft slot; and a locking and releasing mechanism, including a first elastic member, a slide sleeve and a fasten ring, wherein the first elastic member is sleeved on the sleeve tube and abutted against one end of the sleeve tube, the slide sleeve is formed with a tube slot sleeved with the shaft cylinder and an outer side of the flange, an opening at one side of the tube slot is formed with an accommodation chamber allowing the first elastic member to be accommodated and abutted against, the sleeve tube is radially formed with a positioning hole allowing a positioning ball to be received, and an inner circumference of the slide sleeve is respectively formed with a stopping wall and a ball chamber corresponding to the location of the positioning ball during two elastic sliding strokes, and the fasten ring is fastened at another end of the sleeve tube for preventing the slide sleeve from being released from the sleeve tube; when the positioning ball is pressed by stopping wall, a part of the positioning ball is exposed in the sleeve slot, so that a sleeve rod of the drive head is unable to be inserted or the positioning ball is buckled in a buckle slot of the sleeve rod; when the slide sleeve is elastically slid at an outer side of the shaft cylinder, the ball chamber is served to allow a part of the positioning ball to be accommodated, thereby allowing the sleeve rod to be inserted into or released from the sleeve slot.

For achieving said objective, another technical solution provided by the present invention is to provide a torque socket having locking and releasing function, which comprises a shaft rod, radially formed with a flange, wherein two sides of the flange are respectively and axially extended with an insertion tenon allowing a rotation tool to be connected and a core shaft axially formed with a shaft hole, an outer circumference of the core shaft is axially formed with at least one cut groove communicated with the shaft hole, and radially formed with a first friction surface; a shaft cylinder, having two axial sides thereof respectively formed with a shaft slot allowing the core shaft to be received and a sleeve tube formed with a sleeve slot, wherein the sleeve slot is served to allow a drive head to be inserted, a second friction surface being in contact with the first friction surface is radially formed inside the shaft slot; and a locking and releasing mechanism, including a first elastic member, a slide sleeve and a fasten ring, wherein the first elastic member is sleeved on the sleeve tube and abutted against one end of the sleeve tube, the slide sleeve is formed with a tube slot sleeved with the shaft cylinder and an outer side of the flange, an opening at one side of the tube slot is formed with an accommodation chamber allowing the first elastic member to be accommodated and abutted against, the sleeve tube is radially formed with a positioning elongated hole allowing a positioning ball to be received, a retractable spring is disposed between the positioning elongated hole and the positioning ball, and an inner circumference of the slide sleeve is formed with a block tenon corresponding to the location of the positioning ball and allowing the positioning ball to be abutted against and two sides of the block tenon are served to respectively define a first ball chamber and a second ball chamber, the fasten ring is fastened at another end of the sleeve tube for preventing the slide sleeve from being released from the sleeve tube; when the sleeve slot is served to allow a sleeve rod of the drive head to be inserted, the sleeve rod enables the positioning ball to be axially and elastically moved in the positioning elongated hole, and a part of the position ball is moved along the block tenon for being radially and elastically moved in the first ball chamber, until a buckle slot of the sleeve rod is buckled with the positioning ball, so that the block tenon is radially abutted against the positioning ball; when the slide sleeve is elastically slid at an outer side of the shaft cylinder, the second ball chamber is served to allow a part of the positioning ball to be accommodated, thereby allowing the sleeve rod to be released from the sleeve slot.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
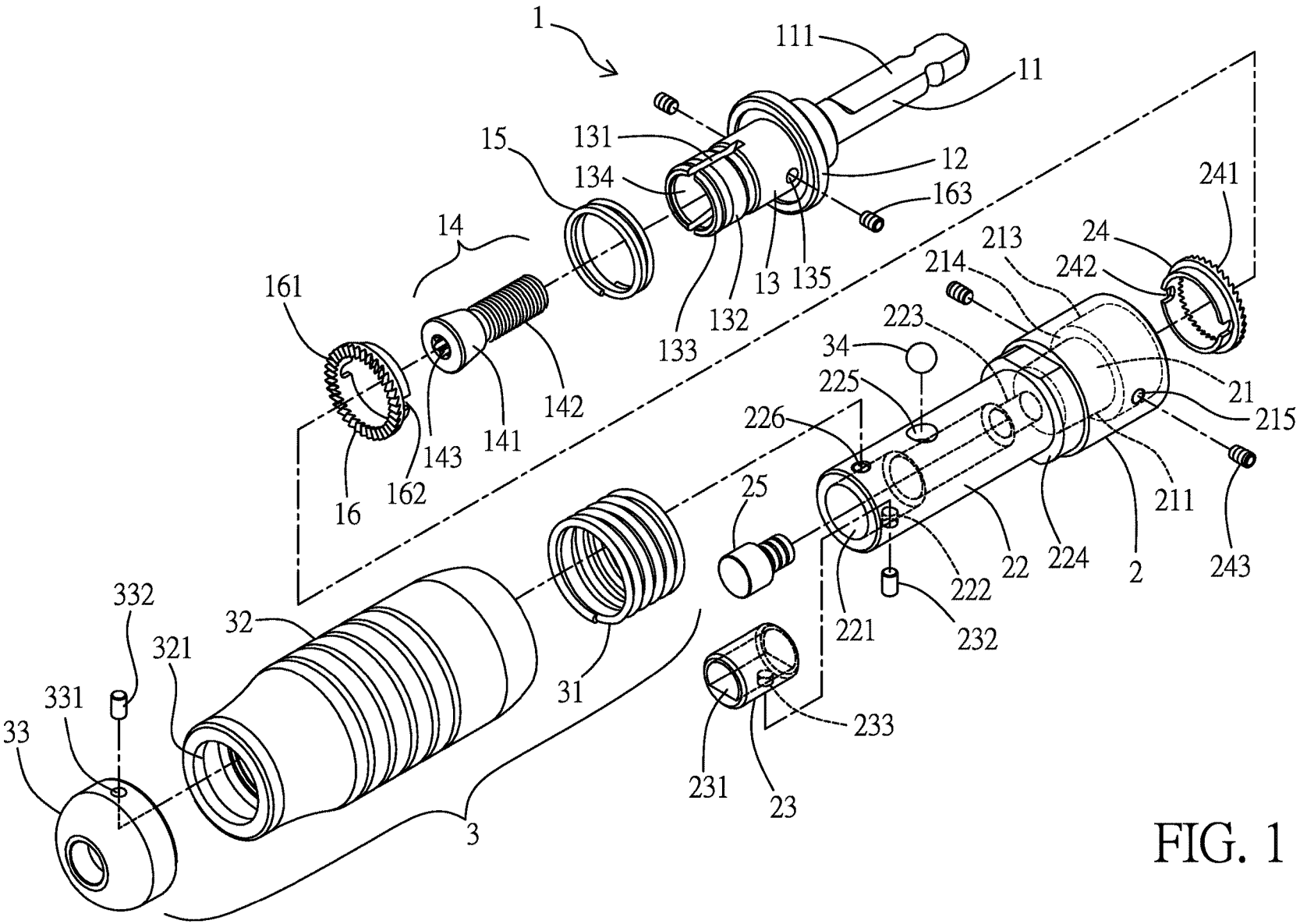
FIG. 1 is a perspective exploded view illustrating a torque socket having locking and releasing function according to a first embodiment of the present invention.
Figure 2:
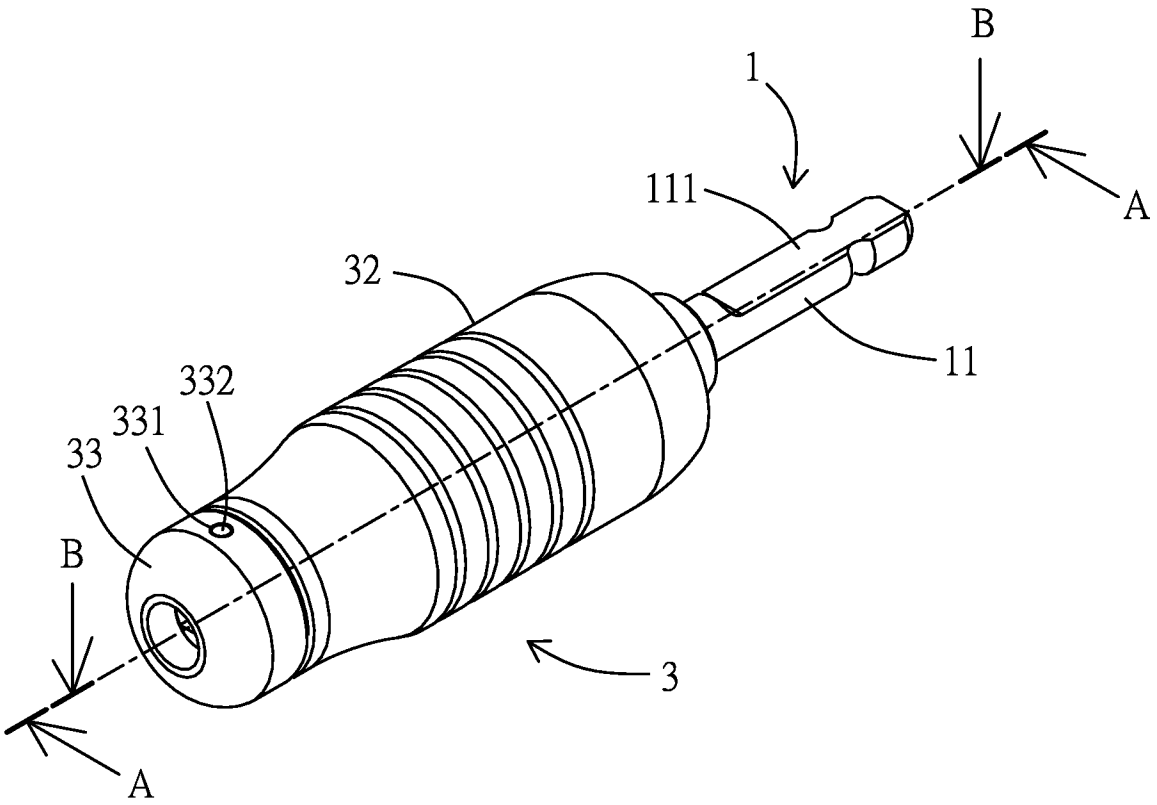
FIG. 2 is a perspective view illustrating the assembly of the torque socket of FIG. 1.

Please refer from FIG. 1 to FIG. 4, a torque socket having locking and releasing function which comprises a shaft rod 1, a shaft cylinder 2 and a locking and releasing mechanism 3 is disclosed according to a first embodiment of the present invention.

The shaft rod 1 is formed as a rod member, one axial side thereof is disposed with an insertion tenon 11, the cross section of the insertion tenon 11 is formed in a non-circular shape, for example a columnar member having at least one flat cutting surface 111, an inner side of the insertion tenon 11 is radially formed with a flange 12, so that a core shaft 13 extended from one side, for example an inner side, of the flange 12 and having a circular cross section can be sleeved with the shaft cylinder 2, another side, for example an outer side, of the insertion tenon 11 is connected to a handgrip hole 41 (shown in FIG. 5) at an bottom end of a rotation tool 4, for example a screwdriver handgrip. An outer circumference of the core shaft 13 is axially formed with at least one cut groove 131, so that a proper elasticity can be provided to the core shaft 13. In addition, the outer circumference of the core shaft 13 is formed with a concave first friction surface 132 and a convex buckle part 133, the core shaft 13 is axially formed with a shaft hole 134, and the shaft hole 134 is communicated with the at least one cut groove 131.

Moreover, for providing a radially expanding or retracting function to the first friction surface 132 of the core shaft 13, an inner circumference of the shaft hole 134 is formed with a conical abutting surface 134*a* of a torque adjusting mechanism, and the abutting surface 134*a* is connected to a connecting segment 134*b*, for example an inner thread.

The shaft hole 134 is served to allow an adjustment member 14 of the torque adjusting mechanism to be received, an outer circumference of the adjustment member 14 is respectively formed with a conical top connecting head 141 and an engaging segment 142, for example an outer thread. An end surface of the top connecting head 141 is axially formed with a rotation hole 143 having a non-circular cross section, for example a hexagonal cross section. When being assembled, a user inserts the adjustment member 14 into the shaft hole 134, then a tool, for example a hexagonal wrench, is inserted into the rotation hole 143 of the top connecting head 141 for rotations, the engaging segment 142 is threaded with the connecting segment 134*b*, and the top connecting head 141 is accommodated in the abutting surface 134*a*, thereby allowing the two conical surfaces to be in a contacting status.

Furthermore, the core shaft 13 is sequentially sleeved, at the inner side of the flange 12, with a second elastic member 15, for example a spring or an elastic disk, and a mobile ratchet 16 of a non-return ratchet structure capable of being axially moved on the core shaft 13, an inner side and an outer side of the mobile ratchet 16 are respectively and axially and annularly disposed with a plurality of unidirectional mobile ratchet teeth 161 and radially formed with at least one position limiting slot 162, a position limiting pin 163 is inserted in a position limiting pin hole 135 radially preformed on the core shaft 13 and inserted into the position limiting slot 162, thereby allowing the mobile ratchet 16 to be axially and elastically moved on the core shaft 13.

Figure 5:
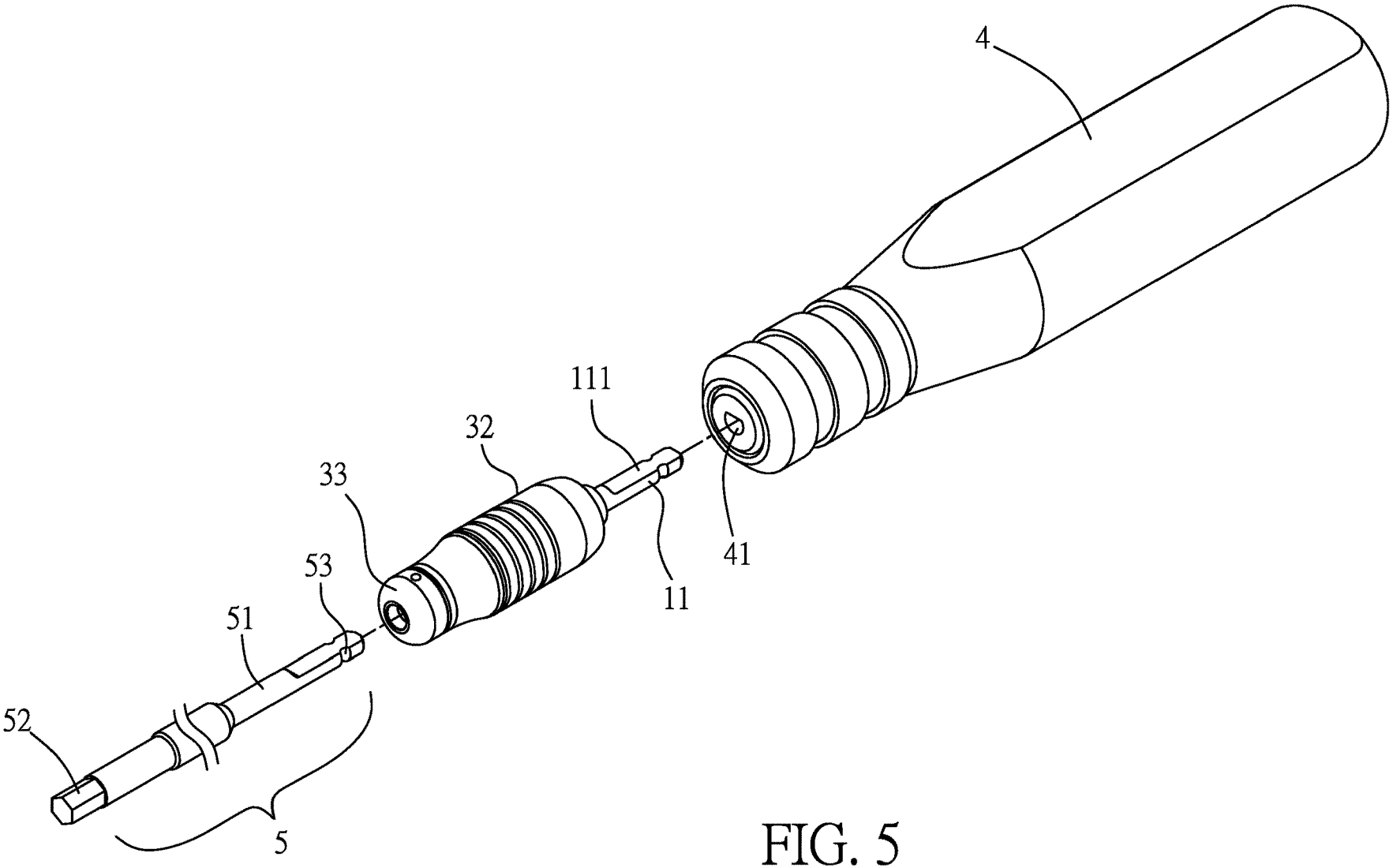
FIG. 5 is a perspective exploded view illustrating the torque socket of FIG. 2, the rotation tool and the drive head.

Two axial sides, for example an inner side and an outer side, of the shaft cylinder 2 are respectively formed with a shaft slot 21 having a circular cross section and a sleeve tube 22 having a sleeve slot 221; in practice, the sleeve slot 221 can be a hole having a non-circular cross section, or the sleeve slot 221 can be formed as a circular hole, but for allowing a sleeve rod having a non-circular cross section (as shown in FIG. 5) of a drive head 5 to be inserted, the interior of the sleeve slot 221 is fastened with an insertion sleeve 23, the insertion sleeve 23 is axially formed with an insertion hole 231 having a non-circular cross section and allowing the sleeve rod 51 to be inserted and positioned. Wherein, a first fastening pin 232 of the insertion sleeve 23 is allowed to pass a first fastening pin hole 222 radially preformed on an outer circumference of the sleeve slot 221 and inserted into a first insertion hole 233 of the insertion sleeve 23, so that the insertion sleeve 23 is fastened inside the sleeve slot 221 and prevented from being rotated.

The dimension of the shaft slot 21 is slightly smaller than the core shaft 13, the above two are mounted and connected with a tightening means so as to form a pivotal shaft structure having stopping and positioning effect. Wherein, the shaft slot 21 is formed as a stepped circular hole, an inner circumference thereof is respectively formed with a second friction surface 211 and a concave buckle part 212 corresponding to the first friction surface 132 and the convex buckle part 133 of the core shaft 13, the convex buckle part 133 is buckled with the concave buckle part 212, thereby preventing the shaft rod 1 and the shaft cylinder 2 from axially falling out. The second friction surface 211 and the first friction surface 132 are tightly arranged, so that a torque is generated between the above two.

An accommodating slot 213 allowing the mobile ratchet 16 to be accommodated is formed between an opening at an outer side of the shaft slot 21 and the second friction surface 211, the interior of the accommodation slot 213 is fastened with a fixed ratchet 24 of the non-return ratchet structure, and an inner side of the fixed ratchet 24 is abutted against an inner block edge 214 radially formed inside the accommodation slot 213, an outer side and an inner side of the fixed ratchet 24 are respectively and axially and annularly disposed with a plurality of unidirectional fixed ratchet teeth 241 and radially formed with at least one positioning slot 242, a positioning pin 243 is allowed to pass a positioning pin hole 215 radially preformed on an outer circumference of the shaft slot 21 and inserted into the positioning slot 242, so that the fixed ratchet 24 is fastened inside the accommodation slot 213 and prevented from being rotated.

If a torque deviation adjustment is desired to be processed, a through hole 223 is formed between the sleeve slot 221 and the shaft slot 21 for allowing the above two to be communicated, so that a maintenance personnel can use the tool, for example the hexagonal wrench, to pass the sleeve slot 221 and the through hole 223, then insert into the rotation hole 143 in the shaft slot 21 for rotations, and the adjustment member 14 is axially moved in the shaft hole 134, the top connecting head 141 is moved along the abutting surface 134*a*, thereby altering the dimension of the outer diameter of the core shaft 13, for example being radially expanded or retracted, and a contact area of the first friction surface 132 and the second friction surface 211 is adjusted, thereby allowing the torque to be adjusted to a preset torque value. When the torque is adjust to the preset torque value, a seal plug 25 is disposed from the sleeve slot 221 and connected, for example adhered, in the through hole 223, so that the through hole 223 is sealed and the possibility of readjusting the adjustment member 14 can be avoided.

The locking and releasing mechanism 3 includes a first elastic member 31, for example a spring or am elastic disk, sleeved on the sleeve tube 22 and abutted against an outer blocking edge 224 at the outer side thereof; a slide sleeve 32 sleeved on the shaft cylinder 2 and the outer side of the flange 12; and a fasten ring 33 fastened at an outer circumference defined at the inner side of the sleeve tube 22.

The slide sleeve 32 is axially formed with a tube slot 321 sleeved on the shaft cylinder 2 and the outer side of the flange 12, an inner circumference defined at an outer opening of the tube slot 321 is formed with an accommodation chamber 322 allowing the first elastic member 31 to be accommodated, the accommodation chamber 322 is formed with a stopping edge 323 arranged to be opposite to the outer blocking edge 224 and allowing the first elastic member 31 to be abutted against, and by compressing the first elastic member 31 or allowing the first elastic member 31 to be in a stretched status, the slide sleeve 32 is able to be axially and elastically slid at the exterior of the shaft cylinder 2.

For providing a locking or releasing effect to the drive head 5, the sleeve tube 22 is radially formed with a positioning hole 225 allowing a positioning ball 34 to be received, and an inner circumference of the slide sleeve 32 is respectively formed with a stopping wall 324 and a ball chamber 325 corresponding to the location of the positioning ball 34 during two elastic sliding strokes, and a guiding inclined surface 326 used for guiding the positioning ball 34 is formed between the stopping wall 324 and the ball chamber 325. When the positioning ball 34 is pressed by stopping wall 324, a part of the positioning ball 34 is exposed in the sleeve slot 221, so that the sleeve rod 51 of the drive head 5 cannot be inserted or the positioning ball 34 is buckled in a buckle slot 53 of the sleeve rod 51; when the ball chamber 325 allows a part of the positioning ball 34 to be accommodated, the sleeve rod 51 is able to be inserted into or released from the sleeve slot 221.

The fasten ring 33 is fastened on the outer circumference defined at the inner side of the sleeve tube 22, thereby preventing the slide sleeve 32 from being released from the sleeve tube 22. A second fastening pin 332 of the fasten ring 33 is allowed to pass a second insertion hole 331 of the fasten ring 33, and inserted into a second fastening pin hole 226 radially preformed on the outer circumference of the sleeve slot 221, so that the fasten ring 33 is able to be fastened on the outer circumference defined at the inner side of the sleeve tube 22 and prevented from being rotated.

The fasten ring 33 is provided with colors or texts indicating the torque value of the torque socket, for example 0.6 Nm (newton-meter), 0.9 Nm, 1.2 Nm, 1.4 Nm, 2.0 Nm, 3.0 Nm, 5.0 Nm, 5.5 Nm, and etc., thus the torque socket having different torque values can adopt the fasten ring 33 having different colors for the purpose of indication, for example, the 0.6 Nm torque socket adopts the red fasten ring 33, and the 0.9 Nm torque socket adopts the yellow fasten ring 33.

As shown from FIG. 1 to FIG. 4, when being assembled, the core shaft 13 of the shaft rod 1 is inserted into the shaft slot 21 of the shaft cylinder 2, and the convex buckle part 133 is buckled with the concave buckle part 212, so that the shaft rod 1 and the shaft cylinder 2 can be prevented from being axially separated. At this moment, the core shaft 13 is sleeved with the mobile ratchet 16 and the second elastic member 15 is served to release energy, so that the unidirectional mobile ratchet teeth 161 of the mobile ratchet 16 and the fixed ratchet teeth 241 of the fixed ratchet 24 are engaged. Then, the first elastic member 31, the slide sleeve 32, the fasten ring 33 and the positioning ball 34 are disposed on the sleeve tube 22, and through the first elastic member 31 being served to release energy, the slide sleeve 32 is abutted against the fasten ring 33, and the positioning ball 34 is pressed by stopping wall 324 at the inner circumference of the tube slot 321, and a part of the positioning ball 34 is exposed in the sleeve slot 221, thereby preventing the drive head 5 from being inserted.

Please refer to FIG. 5, the insertion tenon 11 of the shaft rod 1 is inserted into the handgrip hole 41 at the bottom end of the rotation tool 4, for example the screwdriver handgrip, the sleeve slot 221 of the shaft cylinder 2 allows the selected drive head 5 to be sleeved in, and the locking and releasing mechanism 3 is served to lock or release the drive head 5 with a sliding means. Wherein, the rotation tool 4 is not limited to the above-mentioned screwdriver handgrip. In other words, the torque socket provided by the present invention can also be applied in a pneumatic or an electric rotation tool, and the anticipated locking and releasing function can also be achieved.

In practice, one end of the sleeve rod 51 of the drive head 5 can be formed as, for example but not limited to, a tenon head 52 having a flat shape, a cross shape or any other geometric shape, another end thereof is formed with the buckle slot 53 allowing the positioning ball 34 to be buckled, what shall be addressed is that above mentioned is a well know prior art, therefore no further illustration is provided.

Figure 6:
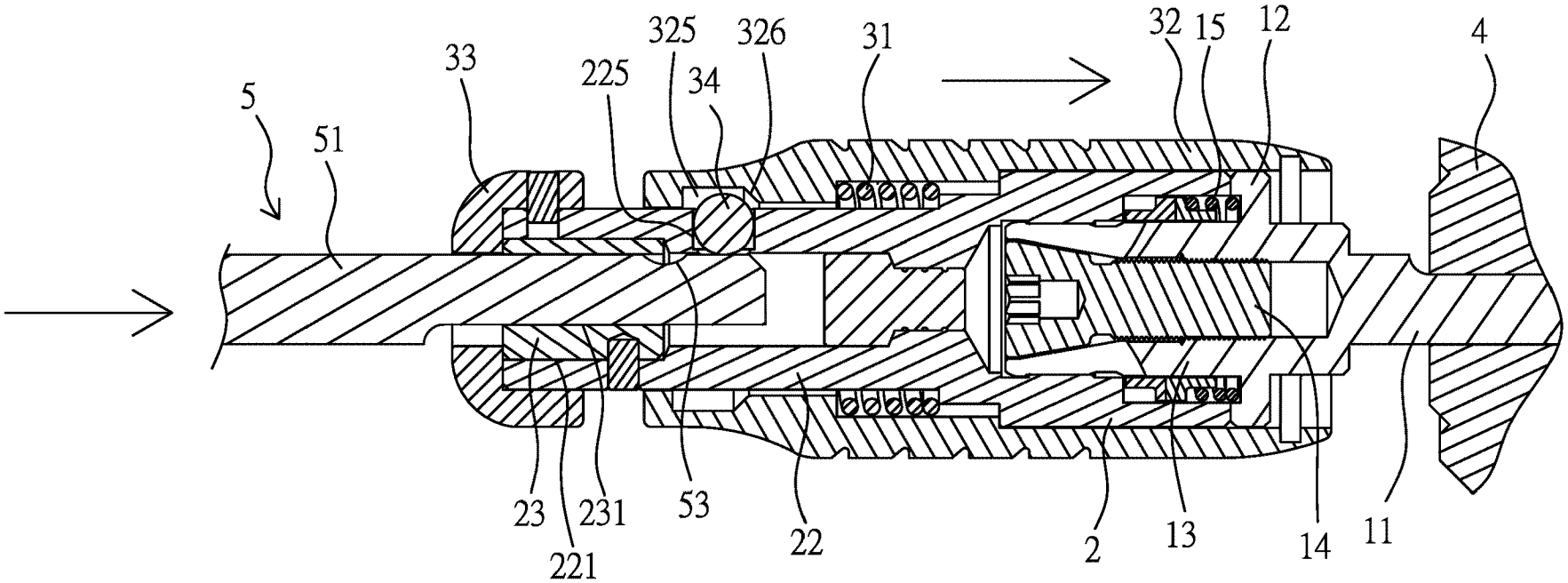
FIG. 6 is a cross sectional view illustrating the assembly of the torque socket of FIG. 5, the rotation tool and the drive head, wherein the drive head being in an inserted status.
Figure 7:
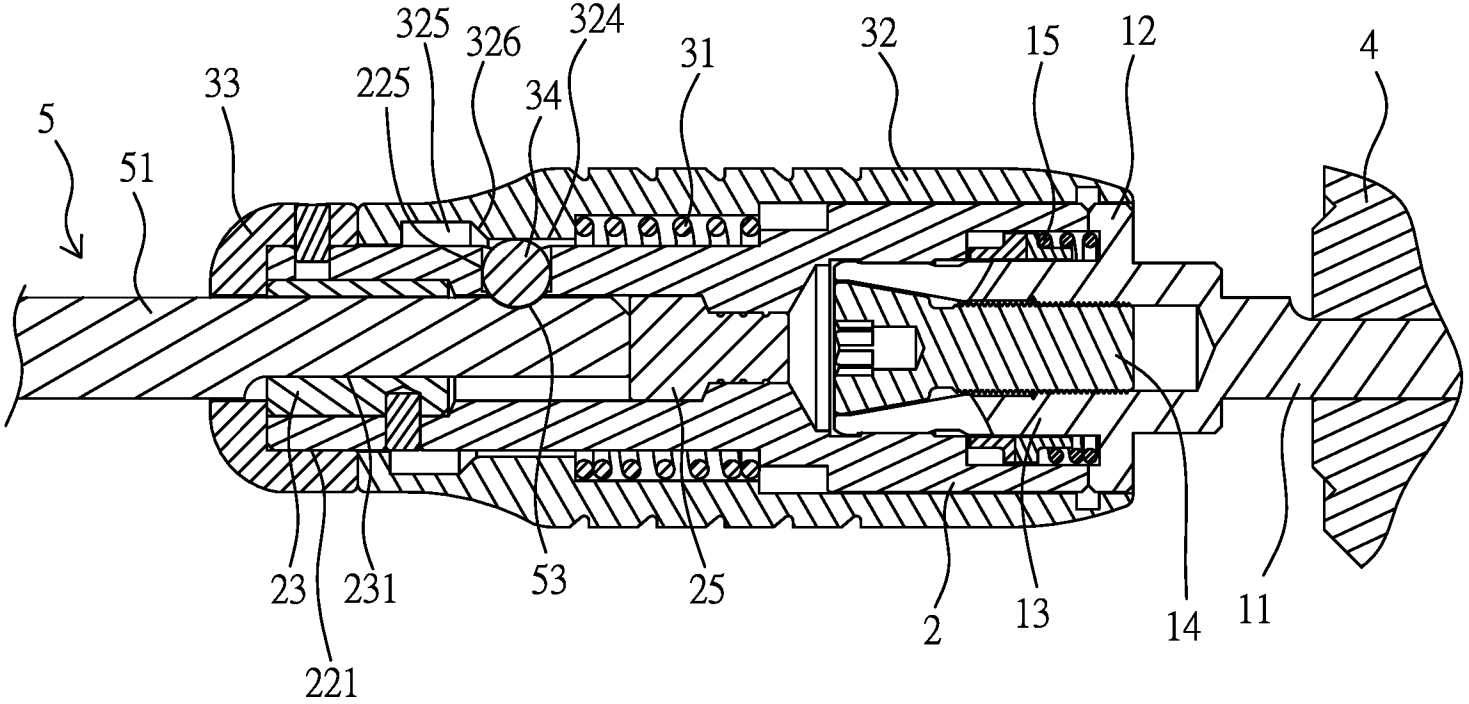
FIG. 7 is a cross sectional view illustrating the drive head of FIG. 6 being locked.

If the drive head 5 is desired to be disposed on the torque socket, firstly the user pushes the slide sleeve 32 towards a direction opposite to the fasten ring 33, the first elastic member 31 is compressed (storing energy), so that the ball chamber 325 is aimed at the positioning ball 34; at this moment, the sleeve rod 51 of the drive head 5 can be inserted from the fasten ring 33, and passed and positioned in the sleeve slot 221, for example the insertion hole 231 of the insertion sleeve 23, until the sleeve rod 51 is in contact and served to push the positioning ball 34, so that the positioning ball 34 is retracted in the positioning hole 225, and a part of the positioning ball 34 enters the ball chamber 325 (as shown in FIG. 6), until the sleeve rod 51 is abutted against the seal plug 25, and the buckle slot 53 is moved to the location of the positioning ball 34, then the slide sleeve 32 is released and returned to the original location via the stretching effect (releasing energy) of the first elastic member 31, and during the process of the slide sleeve 32 sliding towards the fasten ring 33, the positioning ball 34 is released from the ball chamber 325 along the guiding inclined surface 326, and pressed by the stopping wall 324, so that the positioning ball 34 is prevented from being radially moved and tightly buckled in the buckle slot 53, thereby forming a locking effect to the drive head 5 (as shown in FIG. 7).

When the torque socket is desired to be operated, the tenon head 52 of the drive head 5 is aimed at a recessed head of at least one connection member, for example a bone screw, at the periphery of an object to be combined, for example a bone plate, then the rotation tool 4 is rotated by a hand of the user, so that the shaft rod 1 can be served to drive the shaft cylinder 2 and the drive head 5 to be synchronously rotated for processing a locking operation, during a screwing process, if the preset torque value of the torque socket is not exceeded, the bone screw can be continuously screwed in, when the bone screw is rotated and positioned (being locked and tightened) or the preset torque value is exceeded, the core shaft 13 forms an idle rotating status in the shaft slot 21, so that the mobile ratchet teeth 161 of the mobile ratchet 16 sleeved with the core shaft 13 are rotated along the fixed ratchet teeth 241 of the fixed ratchet 24 and axially and elastically moved, so that a sound is generated for reminding the user that the bone screw is in a locking and tightening status or the preset torque value has been reached, thereby preventing the bone screw from being overly locked and tightened.

Figure 3:
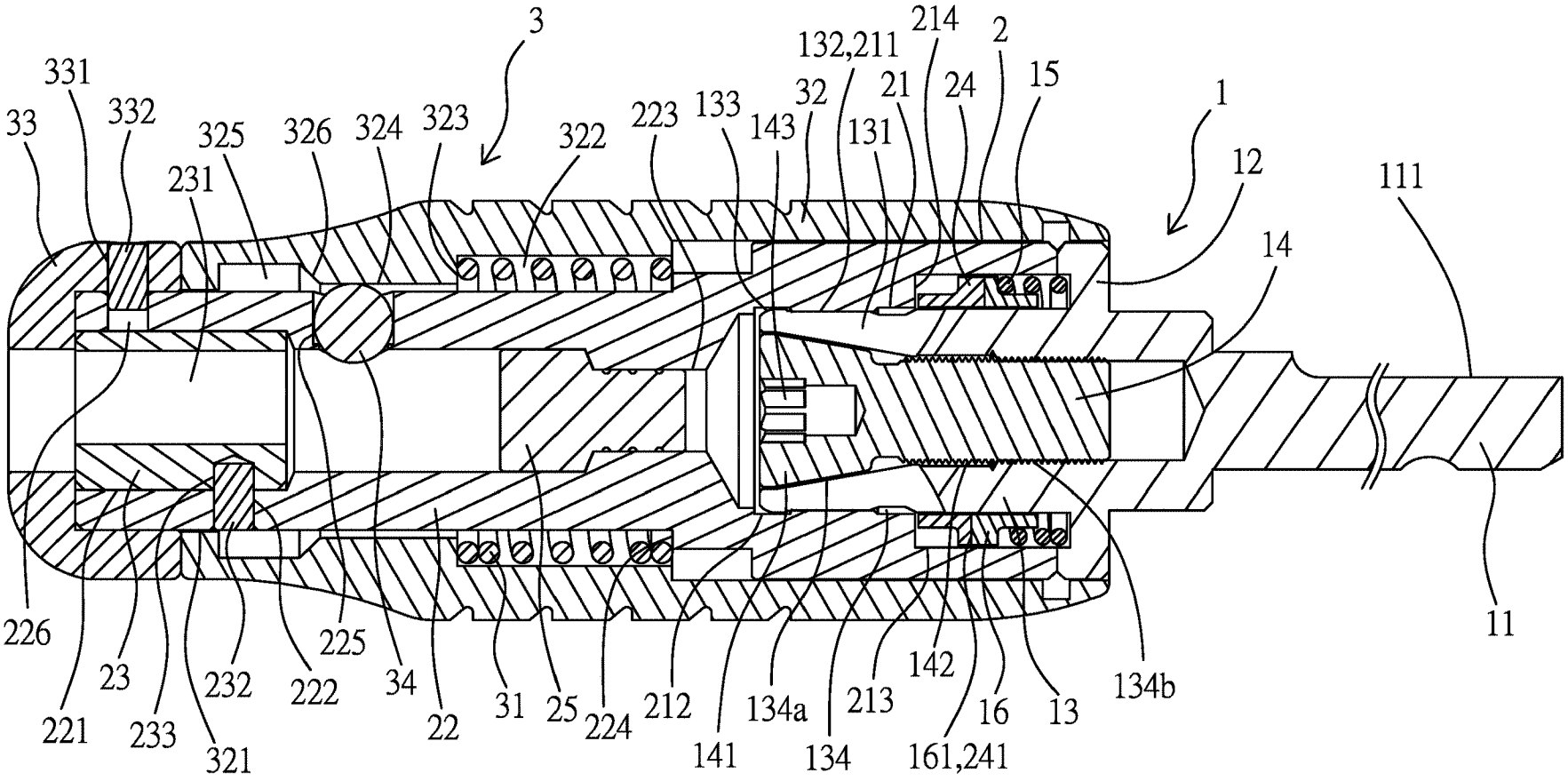
FIG. 3 is a cross sectional view of FIG. 2 taken alone an A-A line.
Figure 4:
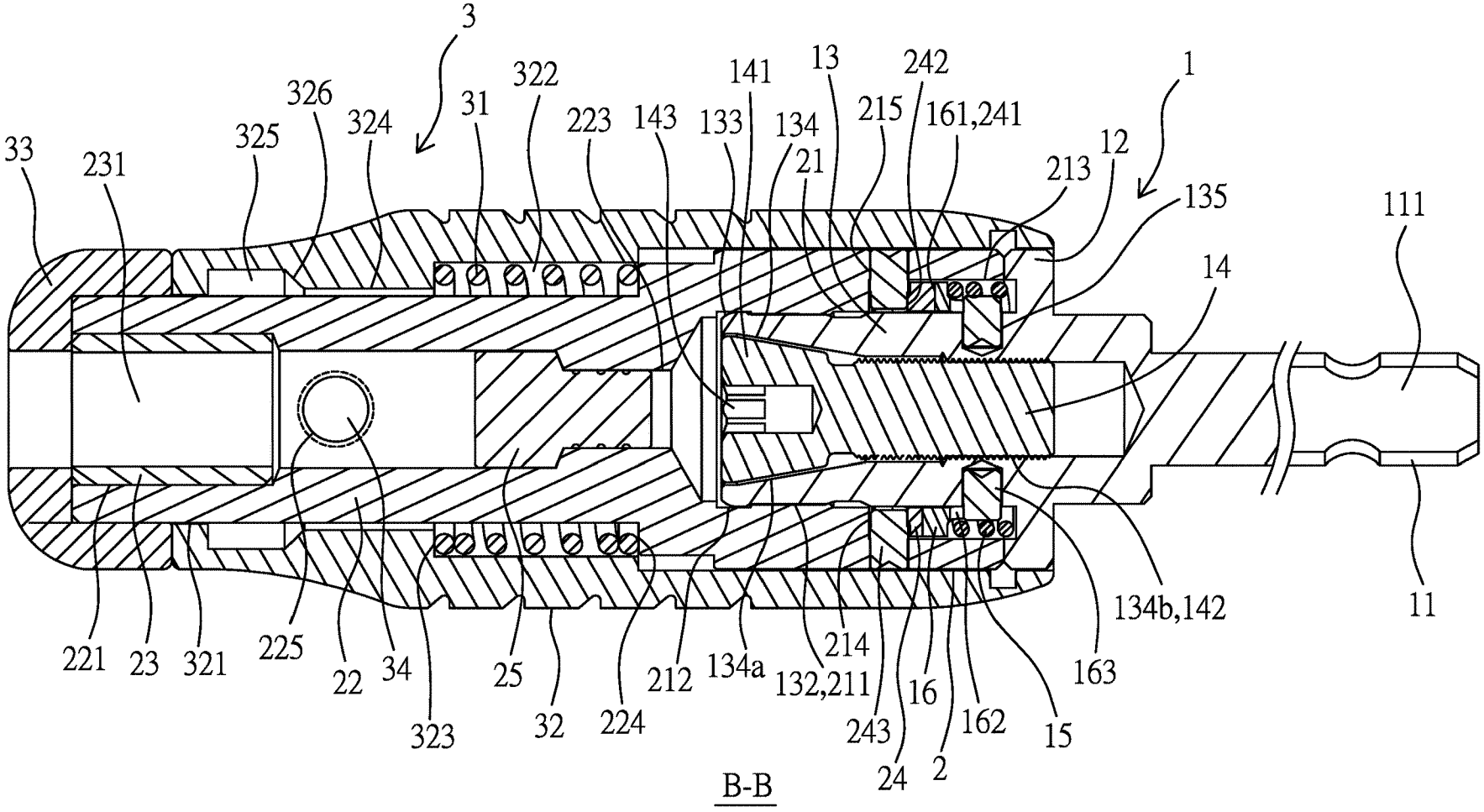
FIG. 4 is a cross sectional view of FIG. 2 taken alone a B-B line.
Figure 8:
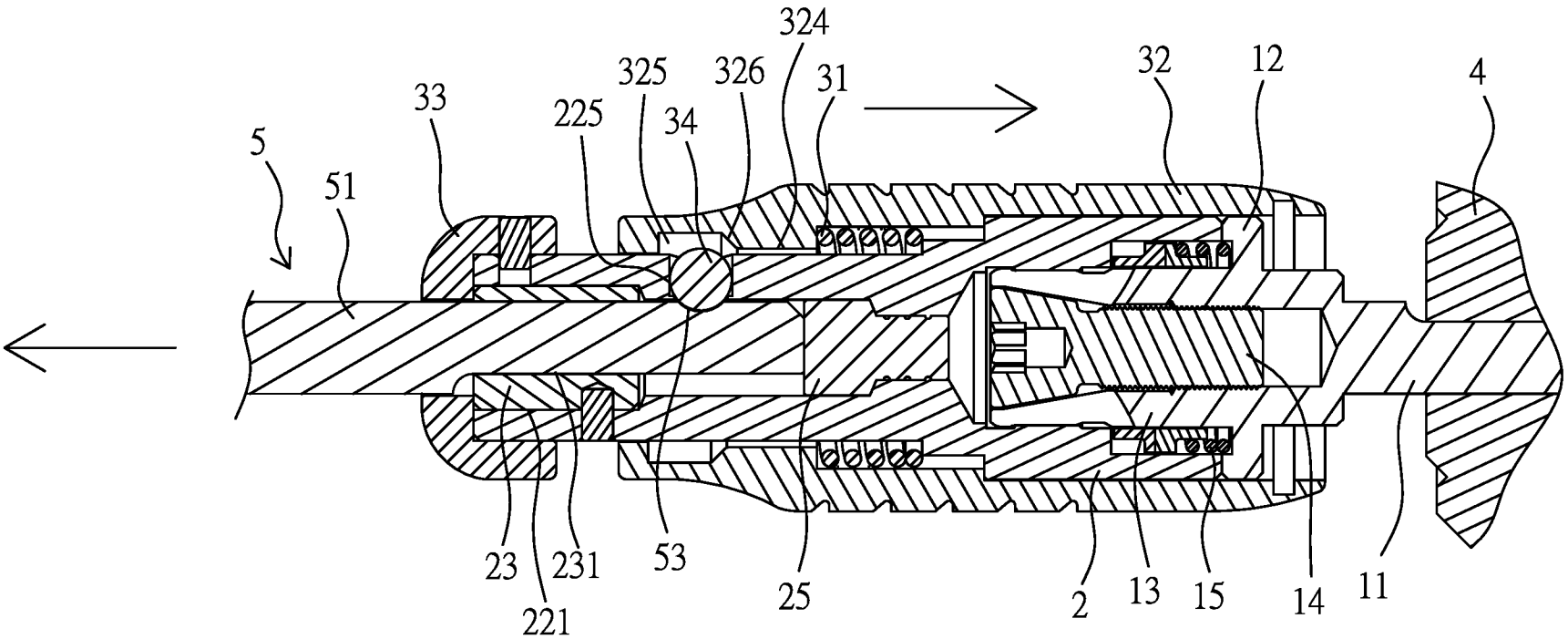
FIG. 8 is a cross sectional view illustrating the drive head of FIG. 6 being released.
Figure 9:
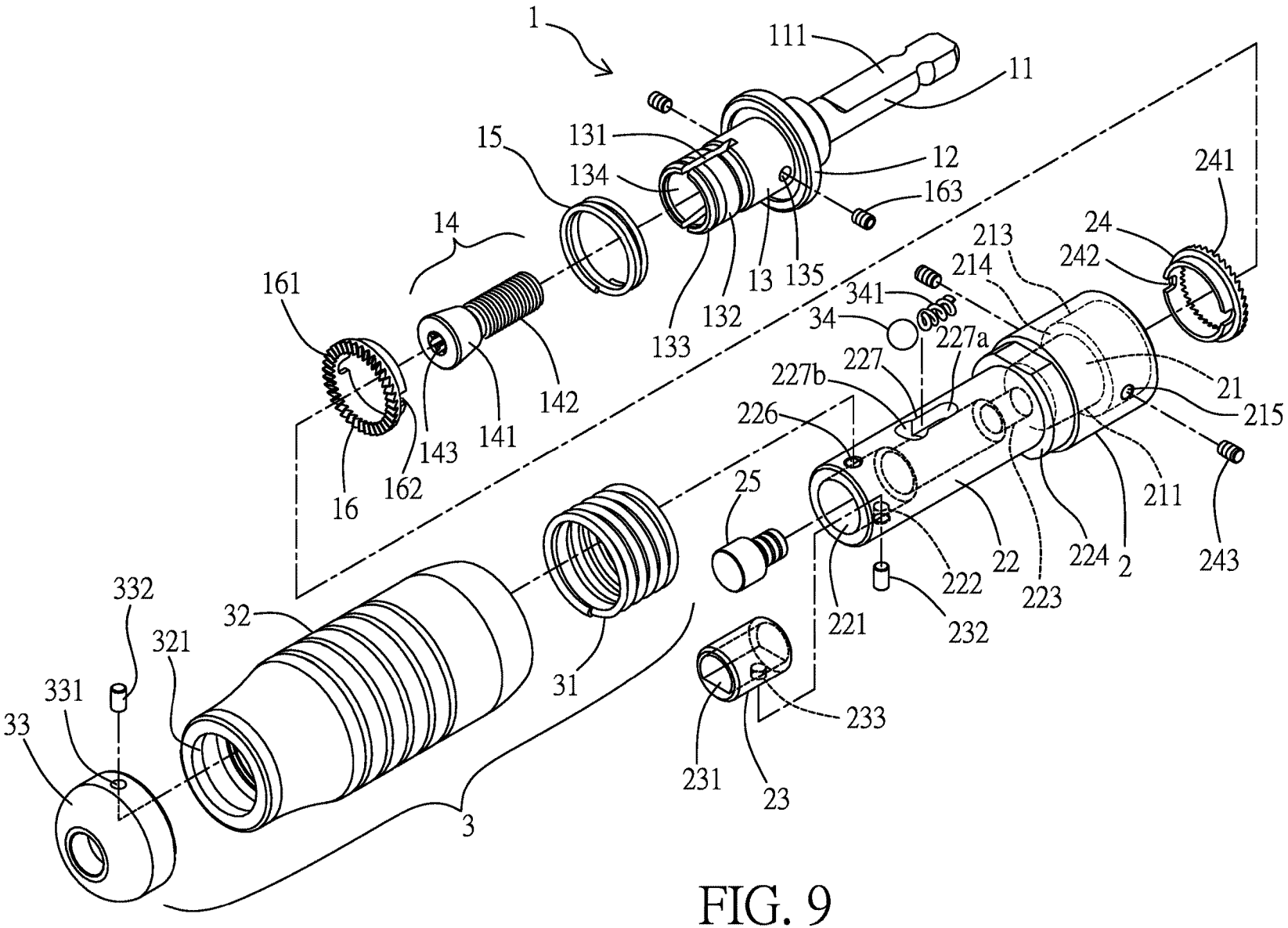
FIG. 9 is a perspective exploded view illustrating the torque socket having locking and releasing function according to a second embodiment of the present invention.

If the drive head 5 is desired to be removed from the torque socket, the user only has to push the slide sleeve 32 towards the direction opposite to the fasten ring 33, the first elastic member 31 is compressed (storing energy), so that the ball chamber 325 is aimed at the positioning ball 34; at this moment, the sleeve rod 51 of the drive head 5 is able to be removed from the sleeve slot 221, for example being removed from the insertion hole 231 of the insertion sleeve 23 (as shown in FIG. 8), until the buckle slot 53 is released from the positioning ball 34, and the sleeve rod 51 is in contact and served to push the positioning ball 34, so that the positioning ball 34 is retracted in the positioning hole 225 and partially received in the ball chamber 325, thereby forming a releasing effect to the drive head 5, thus the drive head 5 can be easily removed from the torque socket, lastly the slide sleeve 32 is released, and the slide sleeve 32 can be returned to the original position through the stretching effect (releasing energy) of the first elastic member 31, and the positioning ball 34 is pressed by the stopping wall 324, thereby prevented from being radially moved (as shown in FIG. 3).

Please refer to FIG. 9 to FIG. 13, which discloses a second embodiment of the torque socket having locking and releasing function provided by the present invention, the same codes shared by the second embodiment and the first embodiment are defined as the same components, because there are a lot of components shared by the second embodiment and the first embodiment, only the differences between the second embodiment and the first embodiment are illustrated hereinafter.

Figure 10:
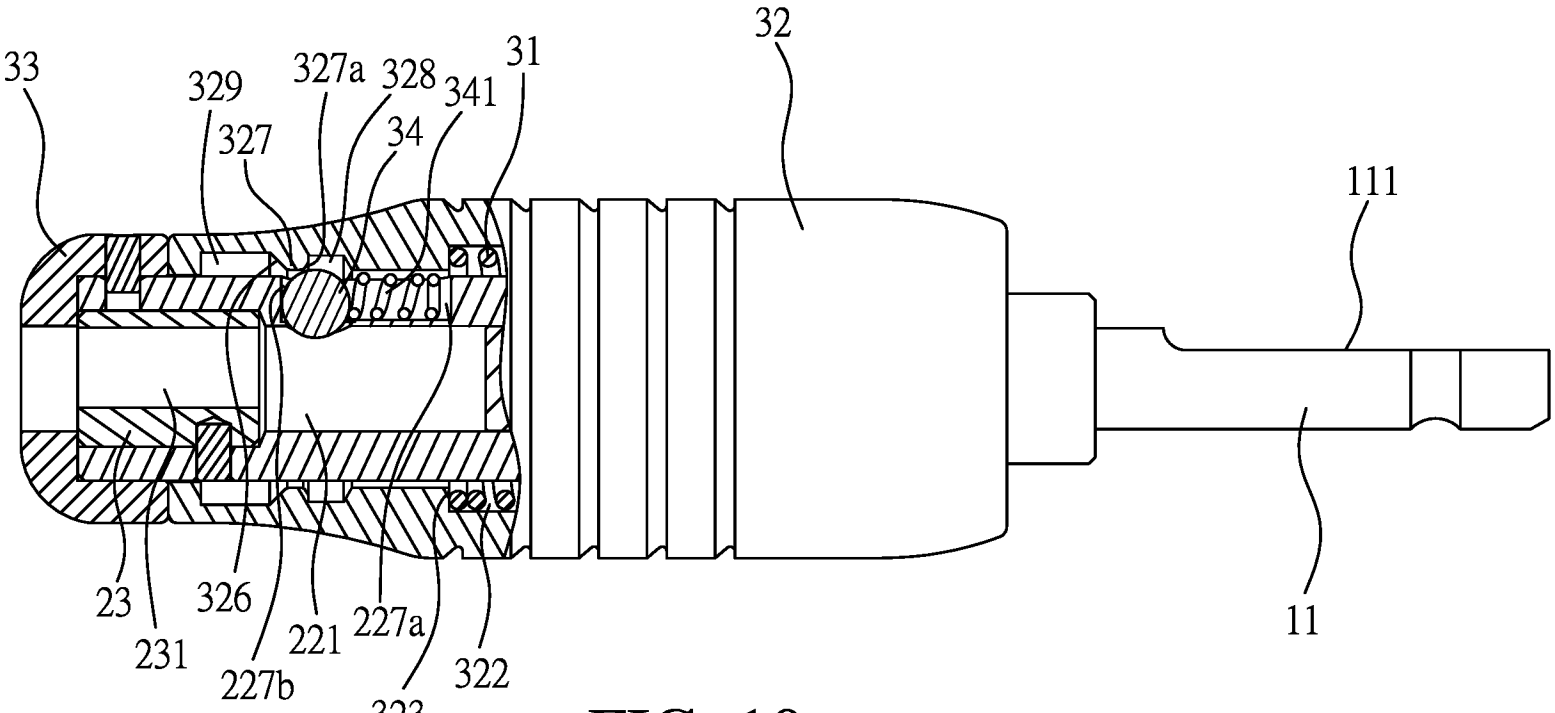
FIG. 10 is a partial cross sectional view illustrating the assembly of the torque socket of FIG. 9.

For providing a locking or releasing effect to the drive head 5, the sleeve tube 22 is radially formed with a positioning elongated hole 227 allowing the positioning ball 34 to be received, a retractable spring 341 is disposed between the positioning elongated hole 227 and the positioning ball 34, so that the positioning ball 34 is able to be axially and elastically moved in the positioning elongated hole 227. Wherein, the positioning elongated hole 227 includes a spring slot **227*a* allowing the retractable spring 341 to be received, and a ball hole 227*b* communicated with the spring slot 227*a* and allowing the positioning ball 34 to be received; the spring slot 227*a* is served to prevent the retractable spring 341 from falling into the sleeve slot 221. The inner circumference of the slide sleeve 32 is disposed with a block tenon 327 corresponding to the location of the positioning ball 34 and capable of abutting against the positioning ball 34 and allowing the positioning ball 34 to be radially and elastically moved, one free end of the block tenon 327 is formed with an arc-shaped surface 327***a* allowing the positioning ball 34 to be radially and elastically moved, and two sides thereof are served to respectively define a first ball chamber 328 and a second ball chamber 329, and the guiding inclined surface 326 is formed between the block tenon 327 and the second ball chamber 329. As shown in FIG. 10, when the arc-shaped surface 327*a* of the block tenon 327 is in contact with the positioning ball 34, a part of the positioning ball 34 is exposed in the sleeve slot 221, but the drive head 5 is able to be directly inserted into the sleeve slot 221.

Figure 11:
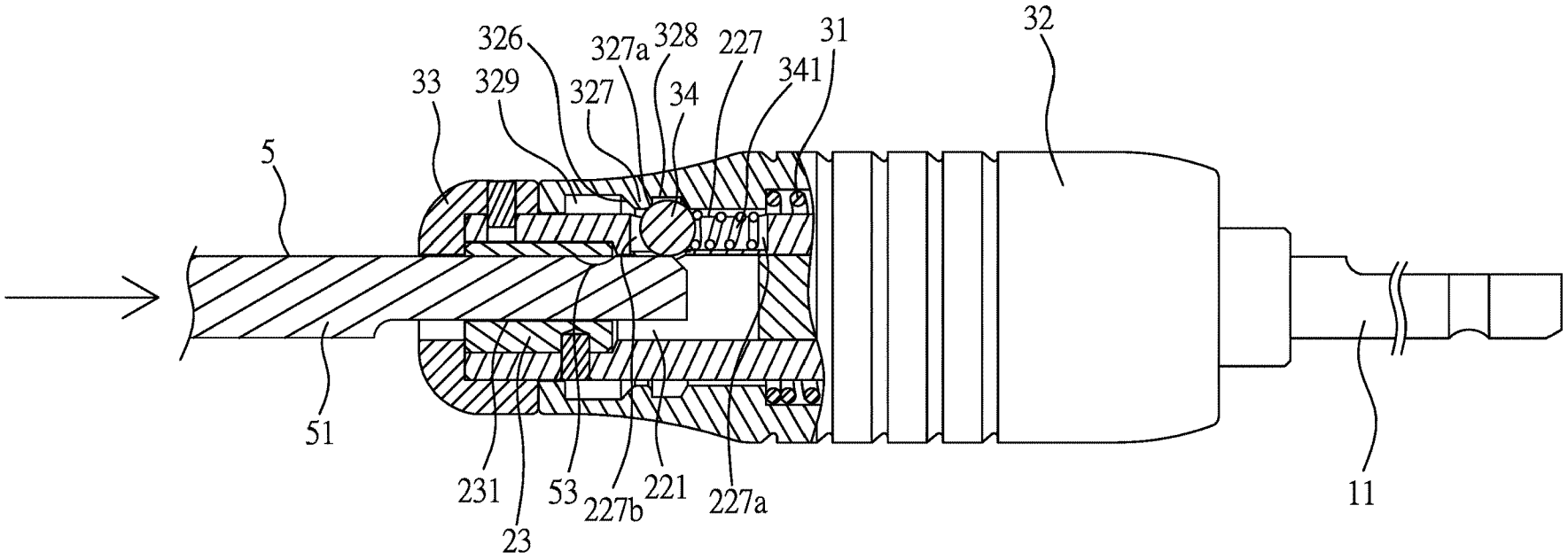
FIG. 11 is a partial cross sectional view illustrating the torque socket of FIG. 10 allowing the drive head to be inserted.
Figure 12:
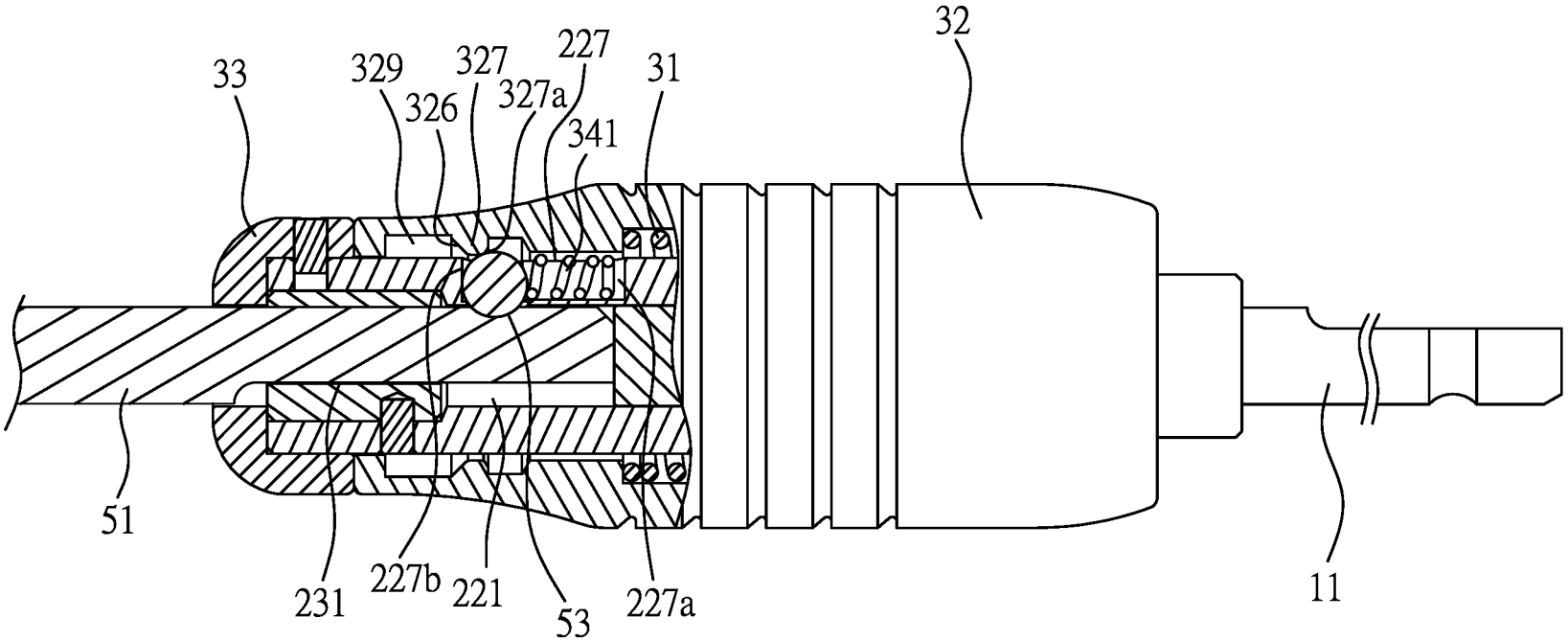
FIG. 12 is a cross sectional view illustrating the drive head of FIG. 11 being locked.
Figure 13:
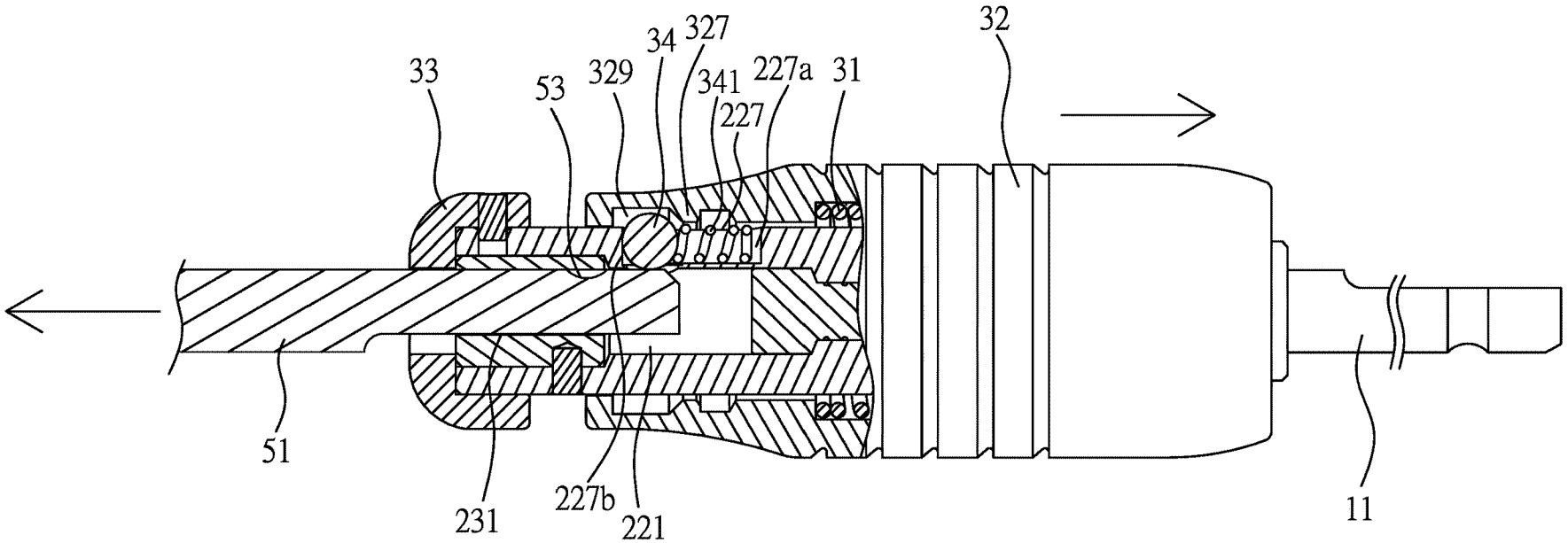
FIG. 13 is a cross sectional view illustrating the drive head of FIG. 11 being released.

If the drive head 5 is desired to be disposed in the torque socket, firstly the user inserts the sleeve rod 51 of the drive head 5 from the fasten ring 33 for allowing the sleeve rod 51 to pass and to be positioned in the sleeve slot 221, for example the insertion hole 231 of the insertion sleeve 23, until the sleeve rod 51 is in contact and served to push the positioning ball 34, so that the positioning ball 34 is able to axially compress the retractable spring 341 (storing energy), and a part of the positioning ball 34 is radially and elastically moved along the arc-shaped surface 327*a* to the interior of the first ball chamber 328 (as shown in FIG. 11), until the sleeve rod 51 is abutted against the seal plug 25, and the buckle slot 53 is moved to the location of the positioning ball 34, the positioning ball 34 is reversely moved through the stretching effect (releasing energy) of the retractable spring 341, so that the positioning ball 34 is buckled in the buckled slot 53, and the block tenon 327 is served to radially abut against the positioning ball 34, thereby forming the locking effect to the drive head 5 (as shown in FIG. 12).

If the drive head 5 is desired to be released from the torque socket, the user only has to push the slide sleeve 32 towards the direction opposite to the fasten ring 33, the first elastic member 31 is compressed (storing energy), so that the second ball chamber 329 is aimed at the positioning ball 34; at this moment, the sleeve rod 51 of the drive head 5 is able to be removed from the sleeve slot 221, for example being removed from the insertion hole 231 of the insertion sleeve 23, until the buckle slot 53 is released from the positioning ball 34, and the sleeve rod 51 is in contact and served to push the positioning ball 34, so that the positioning ball 34 is retracted in the positioning elongated hole 227 and a part thereof is received in the second ball chamber 329, thereby forming the releasing effect to the drive head 5, thus the drive head 5 is able to be easily removed from the torque socket, lastly the slide sleeve 32 is released, and the slide sleeve 32 can be returned to the original position through the stretching effect (releasing energy) of the first elastic member 31, so that the positioning ball 34 is elastically abutted against the block tenon 327 (as show in FIG. 10).

Based on what has been disclosed above, advantages achieved by the present invention are as followings: according to the locking and releasing mechanism disclosed in the two embodiments, the locking and releasing mechanism utilizes a mechanical means for interfering or separating the drive head so as to lock or release the drive head, thereby overcoming a problem of magnetic field interference; moreover, with the adjustment member of the torque adjusting mechanism being axially moved in the core shaft, the dimension of the outer diameter of the core shaft can be altered, for example being radially expanding or retracting, so that the contact area between the core shaft and the shaft slot is able to be adjusted so as to adjust the torque to the preset torque value; furthermore, with the non-return ratchet structure oppositely disposed between the core shaft and the shaft slot, the torque can be prevented from being overly greater than the tolerable range of the connection member, for example a screw, due to the improper screwing, so that the core shaft can be in the idle rotating status in the shaft slot, and the reminding sound can be generated by the non-return ratchet structure, thereby avoiding unnecessary lost; furthermore, the mobile ratchet and the fixed ratchet of the non-return ratchet structure are both unidirectional and capable of being mutually engaged, so that a non-return function is provided for facilitating the loosening operation of the connection member; accordingly, the torque socket having locking and releasing function provided by the present invention is novel and more practical in use comparing to prior art.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific examples of the embodiments disclosed and that modifications and other embodiments are intended to be included within the scope of the appended claims. Although specific terms are employed herein, they are used in a generic and descriptive sense only and not for purposes of limitation.

What is claimed is:

1. A torque socket having locking and releasing function, comprising:

a shaft rod, radially formed with a flange, wherein two sides of said flange are respectively and axially extended with an insertion tenon allowing a rotation tool to be connected and a core shaft axially formed with a shaft hole, an outer circumference of said core shaft is radially formed with at least one cut groove communicated with said shaft hole, and radially formed with a first friction surface;

a shaft cylinder, having two axial sides thereof respectively formed with a shaft slot allowing said core shaft to be received and a sleeve tube formed with a sleeve slot, wherein said sleeve slot is served to allow a drive head to be inserted, a second friction surface being in contact with said first friction surface is radially formed inside said shaft slot; and a locking and releasing mechanism, including:

a first elastic member, sleeved on said sleeve tube and abutted against one end of said sleeve tube;

a slide sleeve, formed with a tube slot sleeved with said shaft cylinder and an outer side of said flange, wherein an opening at one side of said tube slot is formed with an accommodation chamber allowing said first elastic member to be accommodated and abutted against, said sleeve tube is radially formed with a positioning hole allowing a positioning ball to be received, and an inner circumference of said slide sleeve is respectively formed with a stopping wall and a ball chamber corresponding to locations of said positioning ball during two elastic sliding strokes, and a fasten ring, fastened at another end of said sleeve tube for preventing said slide sleeve from being released from said sleeve tube;

when said positioning ball is pressed by stopping wall, a part of said positioning ball is exposed in said sleeve slot, so that a sleeve rod of said drive head is unable to be inserted or said positioning ball is buckled in a buckle slot of said sleeve rod; when said slide sleeve is elastically slid at an outer side of said shaft cylinder, said ball chamber is served to allow a part of said positioning ball to be accommodated, thereby allowing said sleeve rod to be inserted into or released from said sleeve slot.

2. The torque socket having locking and releasing function as claimed in claim 1, further comprising a torque adjusting mechanism, said torque adjusting mechanism includes a conical abutting surface and a connecting segment formed on an inner circumference of said shaft hole; and an adjustment member disposed in said shaft hole, an outer circumference of said adjustment member is respectively formed with a conical top connecting head abutted against said abutting surface and an engaging segment threaded with said connecting segment; when said adjustment member is rotated, said engaging segment and said top connecting head are respectively and axially moved along said connection segment and said abutting surface, so that a dimension of an outer diameter of said core shaft is able to be altered, and a contact area of said first friction surface and said second friction surface is adjusted, thereby allowing a torque to be adjusted to a preset torque value.

3. The torque socket having locking and releasing function as claimed in claim 2, wherein an end surface of said top connecting head is axially formed with a rotation hole having a non-circular cross section and capable of being driven by a tool for rotations; wherein a through hole is formed between said sleeve slot and said shaft slot for allowing said sleeve slot and said shaft slot to be communicated, and said tool is allowed to pass said sleeve slot and said through and inserted into said rotation hole in said shaft slot, thereby allowing said torque of said torque adjusting mechanism to be adjusted; when said torque is adjusted to said preset torque value, a seal plug is disposed from said sleeve slot and connected to said through hole, thereby sealing said through hole.

4. The torque socket having locking and releasing function as claimed in claim 1, wherein a cross section of said insertion tenon is formed in a non-circular shape, and cross sections of said core shaft, said shaft slot and said sleeve slot are formed in a circular shape, an insertion sleeve in fastened in said sleeve slot, said insertion sleeve is axially formed with an insertion hole allowing said sleeve rod having a non-circular cross section to be inserted and positioned.

5. The torque socket having locking and releasing function as claimed in claim 4, wherein a first fastening pin of said insertion sleeve is allowed to pass a first fastening pin hole radially preformed on an outer circumference of said sleeve slot and inserted into a first insertion hole of said insertion sleeve, thereby allowing said insertion sleeve to be fastened inside said sleeve slot.

6. The torque socket having locking and releasing function as claimed in claim 1, wherein said outer circumference of said core shaft is radially formed with a convex buckle part, and an inner circumference of said shaft slot is formed with a concave buckle part at a location corresponding to said convex buckled part and buckled with said convex buckle part.

7. The torque socket having locking and releasing function as claimed in claim 1, further comprising a non-return ratchet structure, said non-return ratchet structure includes a second elastic member sleeved on said core shaft and abutted against said flange and a mobile ratchet capable of being axially moved on said core shaft and axially and annularly formed with a plurality of unidirectional mobile ratchet teeth; and an accommodation slot formed between said shaft slot and said second friction surface and allowing said mobile ratchet to be accommodated, a fixed ratchet axially and annularly formed with a plurality of unidirectional fixed ratchet teeth is fastened in said accommodation slot, and said fixed ratchet teeth are engaged with said mobile ratchet teeth; when said core shaft is rotated in said shaft slot and said preset torque value is exceeded, said core shaft forms an idle rotating status in said shaft slot, so that said mobile ratchet teeth are rotated along said fixed ratchet teeth, and said mobile ratchet is axially and elastically moved so as to generate a sound.

8. The torque socket having locking and releasing function as claimed in claim 7, wherein said mobile ratchet is radially formed with at least one position limiting slot, and a position limiting pin is allowed to pass said position limiting slot and inserted into a position limiting pin hole radially formed on said core shaft, thereby allowing said mobile ratchet to be axially moved on said core shaft; said fixed ratchet is radially formed with at least one positioning slot, and a positioning pin is allowed to pass a positioning pin hole radially formed in said shaft slot and inserted in said positioning slot, thereby preventing said fixed ratchet from being rotated in said accommodation slot.

9. The torque socket having locking and releasing function as claimed in claim 1, wherein a second fastening pin of said fasten ring is allowed to pass a second insertion hole of said fasten ring, and inserted into a second fastening pin hole radially preformed on said outer circumference of said sleeve slot, thereby allowing said fasten ring to be fastened at another end of said sleeve tube.

10. The torque socket having locking and releasing function as claimed in claim 1, wherein a guiding inclined surface used for guiding said positioning ball is formed between said stopping wall and said ball chamber.

* * * * *